US008316479B2

(12) United States Patent
Colombo

(10) Patent No.: US 8,316,479 B2
(45) Date of Patent: Nov. 27, 2012

(54) CONVERTIBLE FURNITURE UNIT

(75) Inventor: Pierluigi Colombo, Milan (IT)

(73) Assignee: Clei S.R.L., Carugo (Como) (IT)

( * ) Notice: Subject to any disclaimer, the term of this patent is extended or adjusted under 35 U.S.C. 154(b) by 132 days.

(21) Appl. No.: 12/736,435

(22) PCT Filed: Apr. 14, 2009

(86) PCT No.: PCT/EP2009/002707

§ 371 (c)(1),
(2), (4) Date: Oct. 7, 2010

(87) PCT Pub. No.: WO2009/127382

PCT Pub. Date: Oct. 22, 2009

(65) Prior Publication Data

US 2011/0023230 A1 Feb. 3, 2011

(30) Foreign Application Priority Data

Apr. 15, 2008 (IT) ..... MI2008A0679

(51) Int. Cl.
*A47C 17/50* (2006.01)

(52) U.S. Cl. ..... 5/8; 5/133; 5/136

(58) Field of Classification Search ..... 5/1, 2.1, 5/133, 136, 43, 8

See application file for complete search history.

(56) References Cited

U.S. PATENT DOCUMENTS

| | | | | |
|---|---|---|---|---|
| 5,652,978 | A * | 8/1997 | Wiig | 5/144 |
| 7,451,503 | B2 * | 11/2008 | Caillaud | 5/8 |
| 2001/0044960 | A1 * | 11/2001 | Schwalbe, Jr. | 5/136 |

FOREIGN PATENT DOCUMENTS

| | | | |
|---|---|---|---|
| DE | 858 594 | C | 12/1952 |
| EP | 0 011 531 | A | 5/1980 |
| EP | 1 897 468 | A | 3/2008 |

* cited by examiner

*Primary Examiner* — Fredrick Conley
(74) *Attorney, Agent, or Firm* — R. Neil Sudol; Coleman Sudol Sapone P.C.

(57) ABSTRACT

A convertible furniture unit constituted by a sofa having an exposed wall and that can be converted into a folding double bed or into two mutually separate single beds. The conversion from double bed to two single beds occurs in the day version, with the beds arranged vertically, by virtue of the sliding movement on a rail (6) of the two portions (2, 3). The spring-based balancing system, the levers (18) and the fulcrums (22) of rotation are inside the supporting structure. The shoulders (8, 9) of the piece of furniture that embed the sprung bases in the day position are fixed to the sprung bases themselves and, by rotation, become the side boards of the bed in the night position; in this manner, the unit does not have, in the night version, the appearance of exposed wall-mounted furniture. The unit also allows, in the day version, to join without gaps the two seats into a sofa and, in the night version, to join the two single beds to form a double sprung base.

19 Claims, 8 Drawing Sheets

CONVERTIBLE FURNITURE UNIT

BACKGROUND OF THE INVENTION

The present invention relates to a convertible furniture unit, namely a day bed constituted by an integrated sofa having an exposed wall and that can be converted into a bed.

Over time, several structures have been proposed for providing a furniture unit with the dual function of sofa and bed.

The purpose of such structures is to provide a piece of furniture which performs the functions of a sofa during the day without occupying the space of an actual bed.

Another important feature of a day bed should be that of being equally comfortable when used as a sofa as well as when used as a bed.

Also, the need is increasingly felt to provide beds that are comfortable and allow a correct position of the user from an orthopedic standpoint.

That feature is difficult to achieve with day beds in which the resting surface, in the bed position, is constituted by multiple mutually hinged transverse sections.

Those two goals are achieved, in few day beds, by virtue of sophisticated mechanisms that allow both to substantially reduce the dimensions in the sofa position and to provide at the same time a comfortable bed and a functional sofa.

The problem of significantly reducing the dimensions in the folded position is particularly felt in furniture units that convert from a sofa into a double bed.

Another essential required characteristic is of course the aesthetic one.

In this regard, many of the conventional day beds have the drawback of limiting the aesthetic possibilities of the furniture unit due to the mechanisms that have to be used.

Another limitation of traditional day beds is that, in general, they are separate structures: one type can be converted from a sofa into a double bed, a second type can be converted from a sofa into two single beds arranged side by side, or a third bed includes a first sprung base that constitutes the sitting portion of the sofa and a second sprung base that is stored below the first one and can be extracted to constitute a second bed.

OBJECTS OF THE INVENTION

The aim of the present invention is to provide a convertible furniture unit, particularly an integrated sofa having an exposed wall and that can be converted into a bed, having superior functional and aesthetic characteristics with respect to conventional units.

A particular object of the invention is to provide a unit that has higher versatility in use.

A further object of the invention is to provide a convertible furniture unit whose conversion from sofa to bed and vice versa is simple and easy.

A further object of the invention is to provide a convertible furniture unit that is comfortable both when used as a sofa and when used as a bed.

A further object is to provide a unit whose aesthetic appearance is pleasant and attractive both in the sofa version and in the bed version.

A further object of the present invention is to provide a unit which, by virtue of its particular constructive features, is reliable and safe in use.

SUMMARY OF THE INVENTION

This aim and these and other objects that will become better apparent hereinafter are achieved by a convertible furniture unit characterized in that it comprises a first portion and a second portion, each portion being respectively associated with a first seat part and with a second seat part, each of said portions constituting a single bed that can be tilted down onto the respective seat part; said first portion, with said first seat part, being associated with said second portion, with said seat part, by means of a rail member, which allows mutual transverse sliding of said two portions, forming a joined position and a separated position, in said joined or separated positions said two wall portions being able to tilt down in order to convert said unit from a sofa into a double bed, if said portions are joined, into two separate single beds, if said portions are separated.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
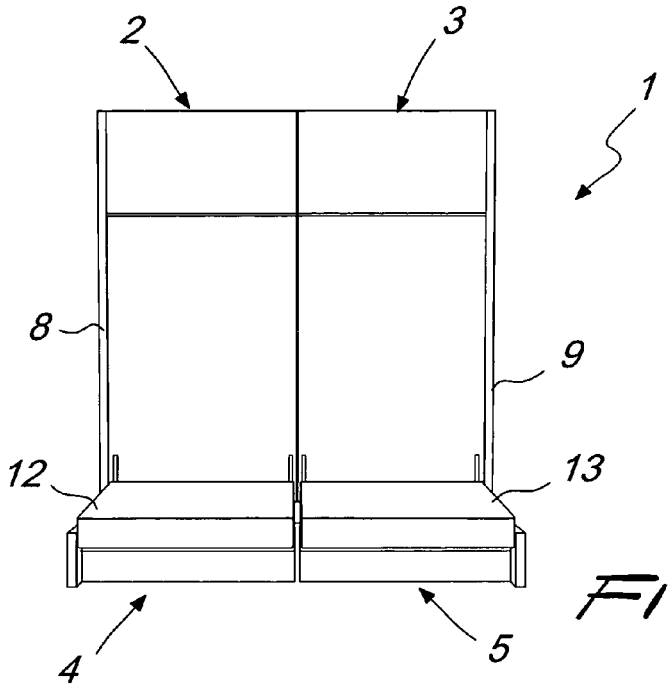
FIG. 1 is a front perspective view of the unit in the day position.

With reference to the cited figures, the convertible furniture unit according to the invention, generally designated by the reference numeral 1, comprises an exposed wall constituted by a first portion 2 and by a second portion 3. Each portion is respectively associated with a first seat part 4 and with a second seat part 5.

Each wall portion 2 and 3 constitutes a single bed that can be tilted onto the respective seat part 4 and 5.

Figure 2:
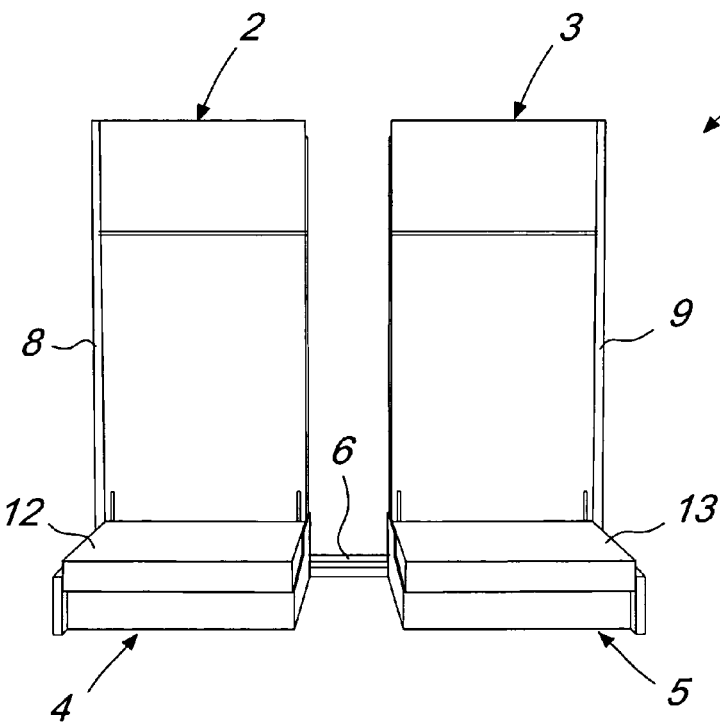
FIG. 2 is a front perspective view of the unit in the day position, shown with the two portions separated.
Figure 3:
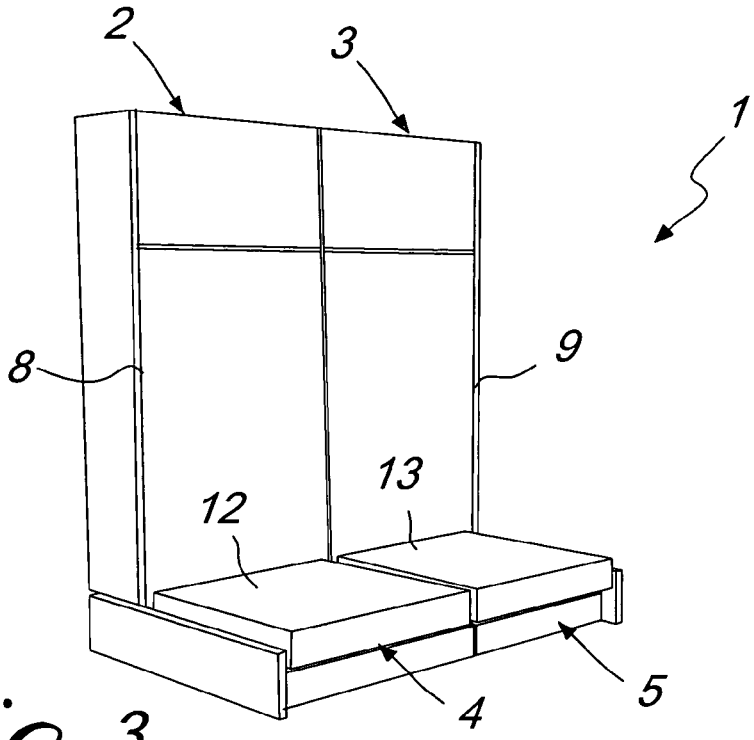
FIG. 3 is a perspective view of the unit in the day position.
Figure 4:
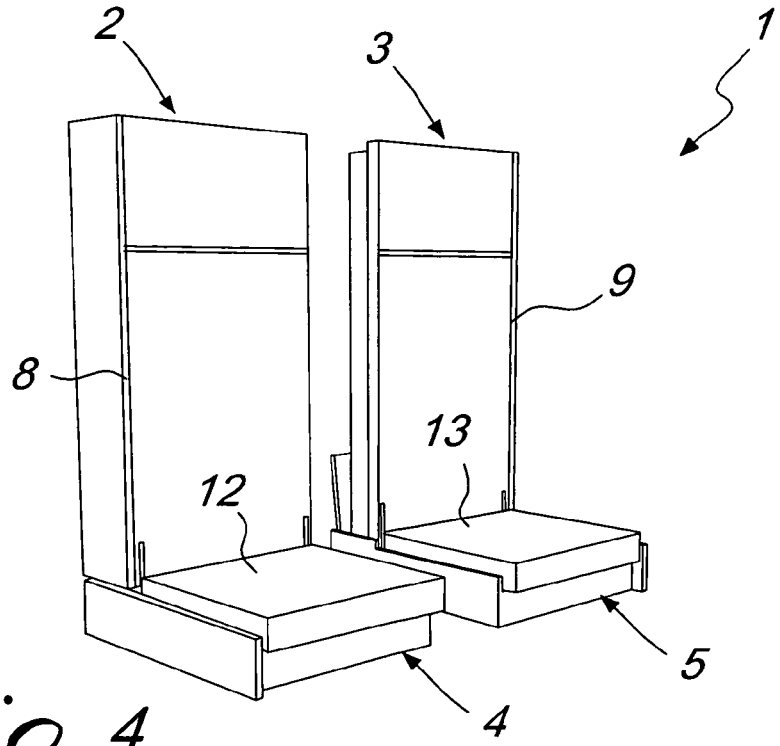
FIG. 4 is a perspective view of the unit in the day position, shown with the two portions separated.

The first wall portion 2, with the first seat part 4, is associated with the second wall portion 3, with the respective seat part 5, by means of a rail member 6, which allows mutual transverse sliding of the two portions, forming a joined position, which is visible in FIGS. 1 and 3, and a separated position, which is visible in FIGS. 2 and 4.

Figure 5:
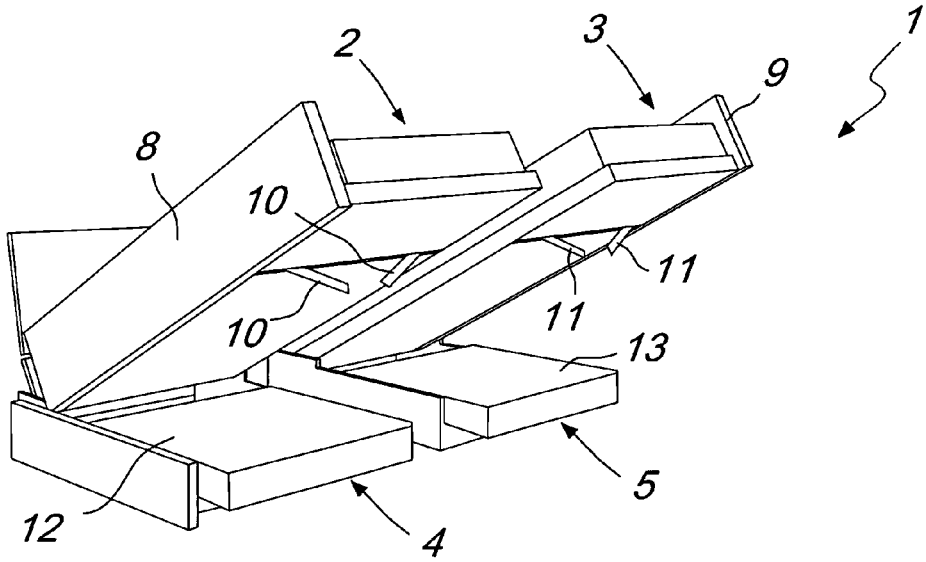
FIG. 5 is a perspective view showing the unit in the step for lowering the sprung bases.
Figure 6:
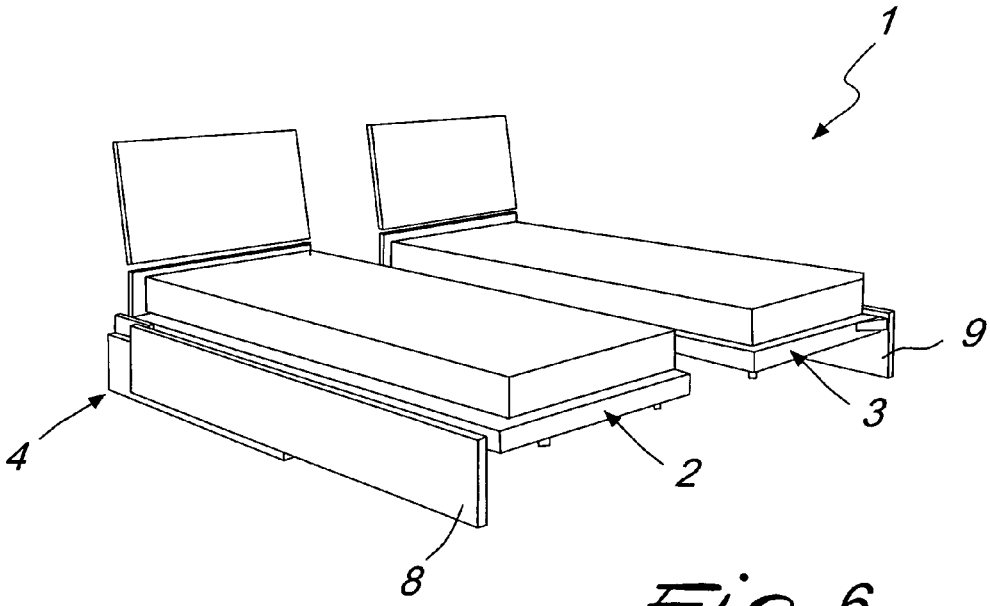
FIG. 6 is a perspective view, of the unit in the night position.
Figure 7:
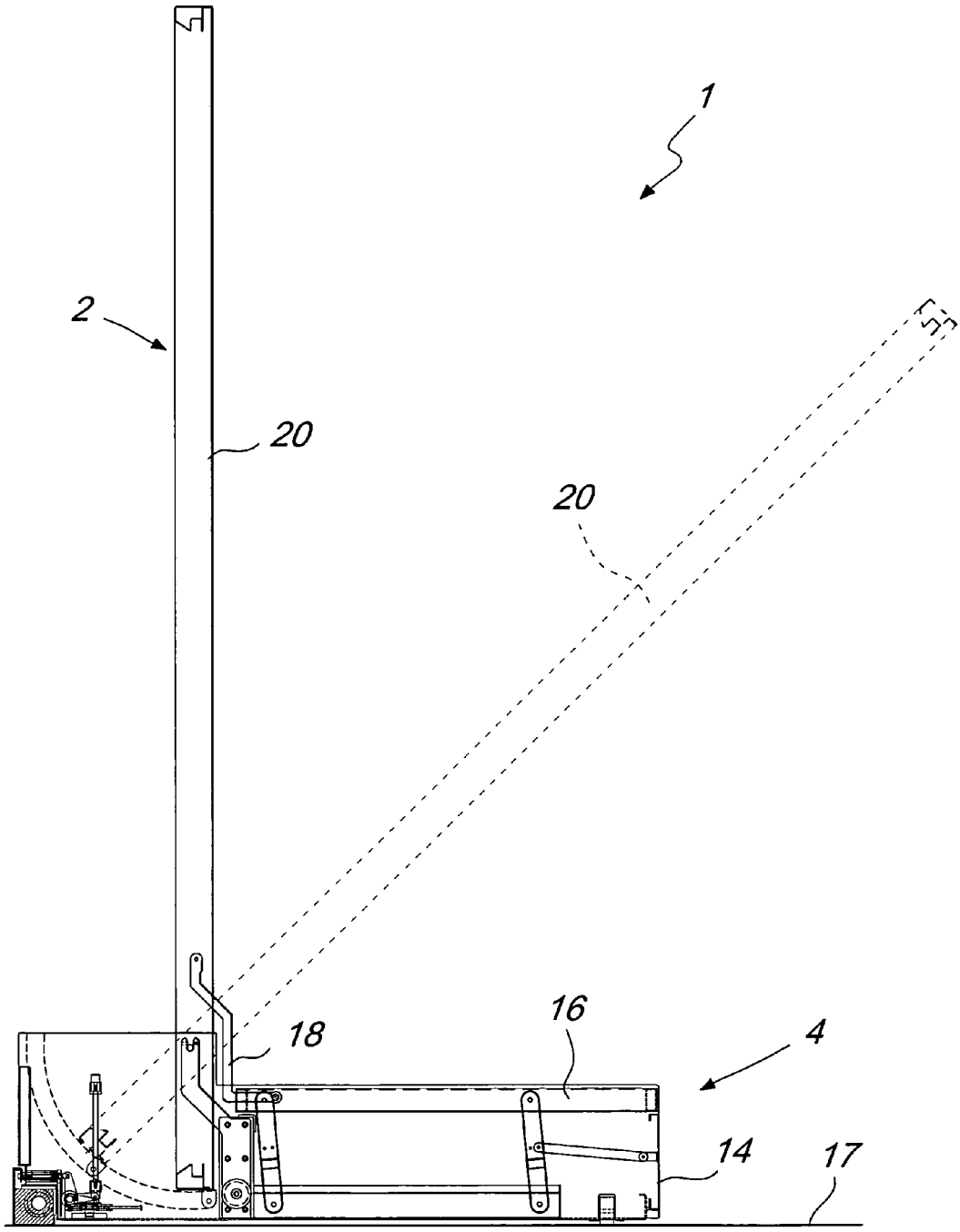
FIG. 7 is a side view of the structural components and of the mechanism for moving the unit in the day position.
Figure 8:
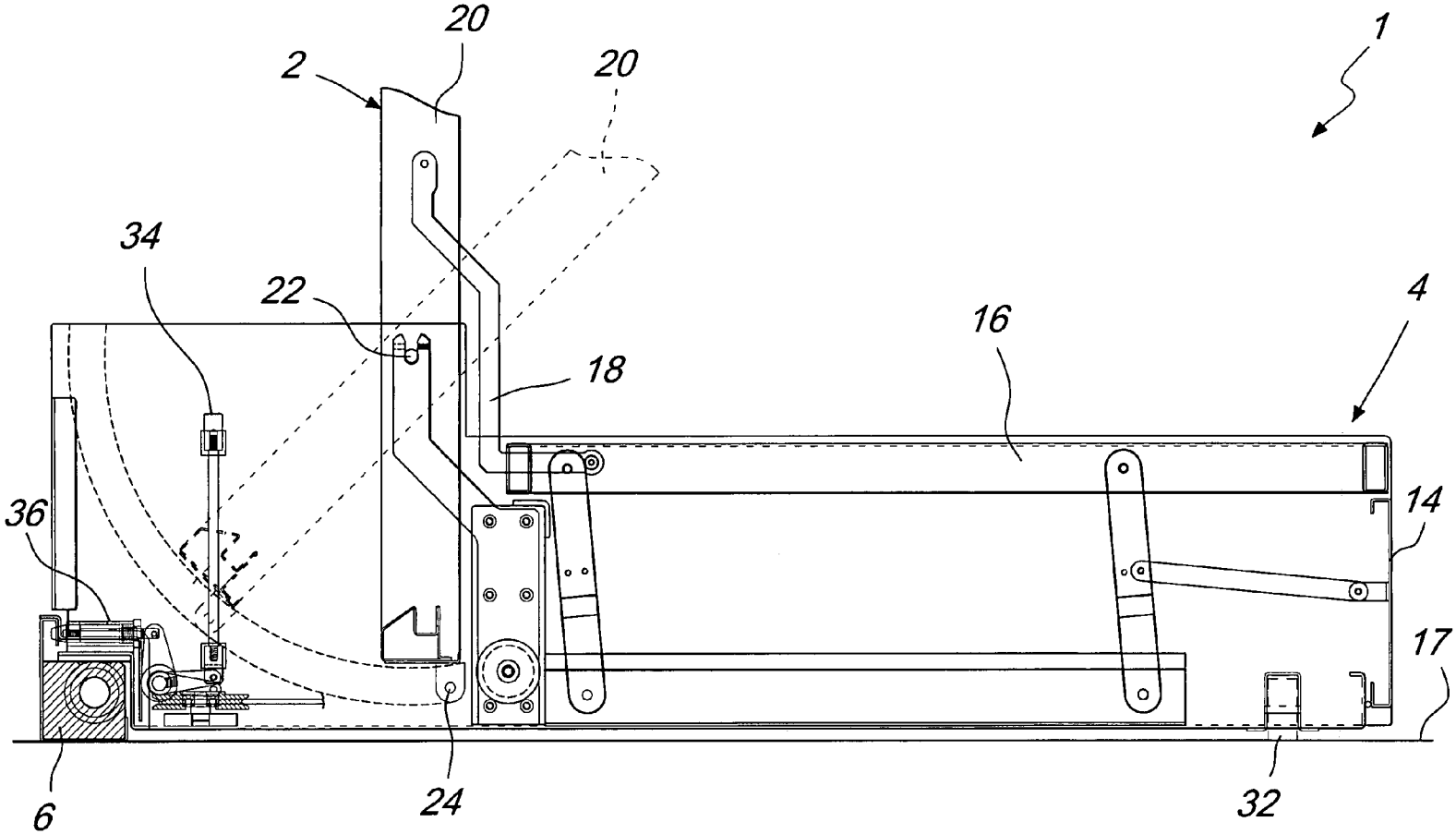
FIG. 8 is a side view, in enlarged scale with respect to the preceding one, of the base chassis.
Figure 9:
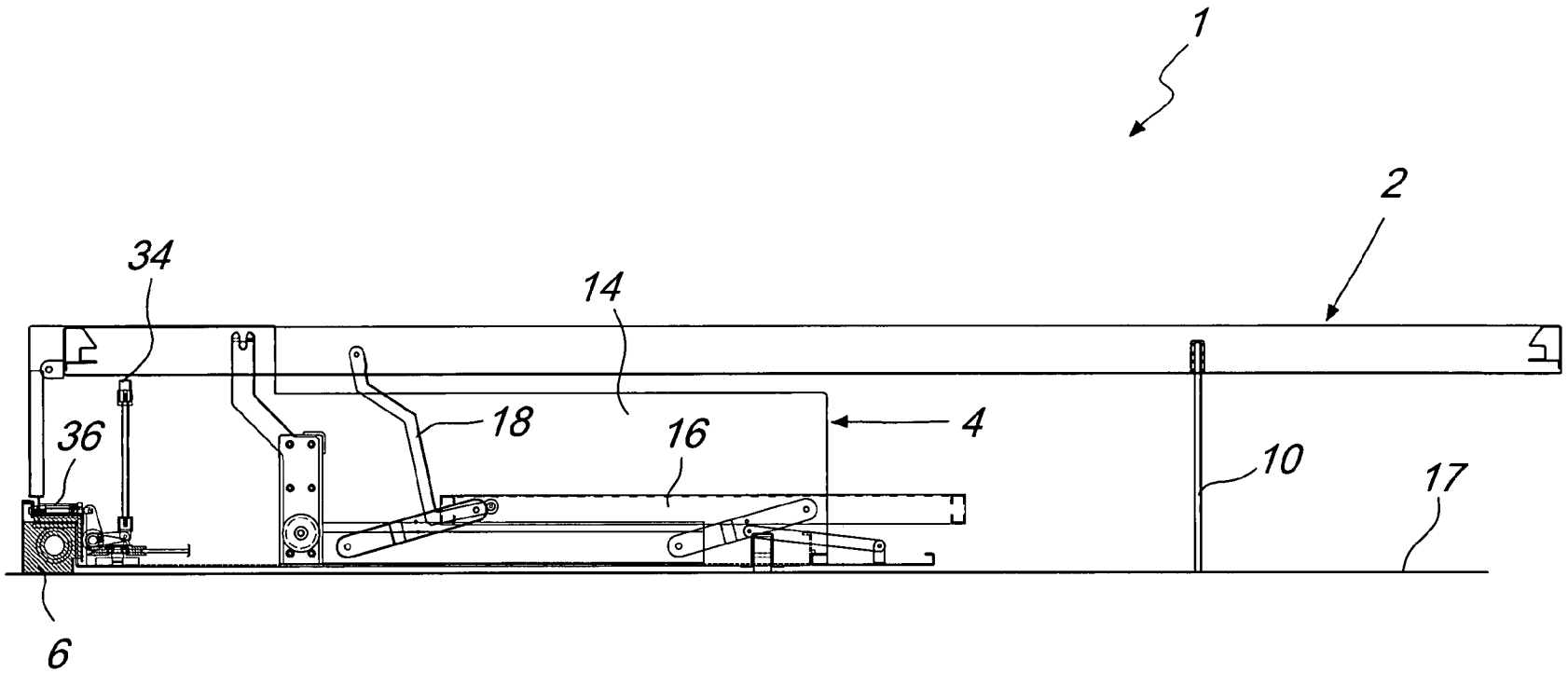
FIG. 9 is a side view, similar to FIG. 7, illustrating the unit in the night position.
Figure 10:
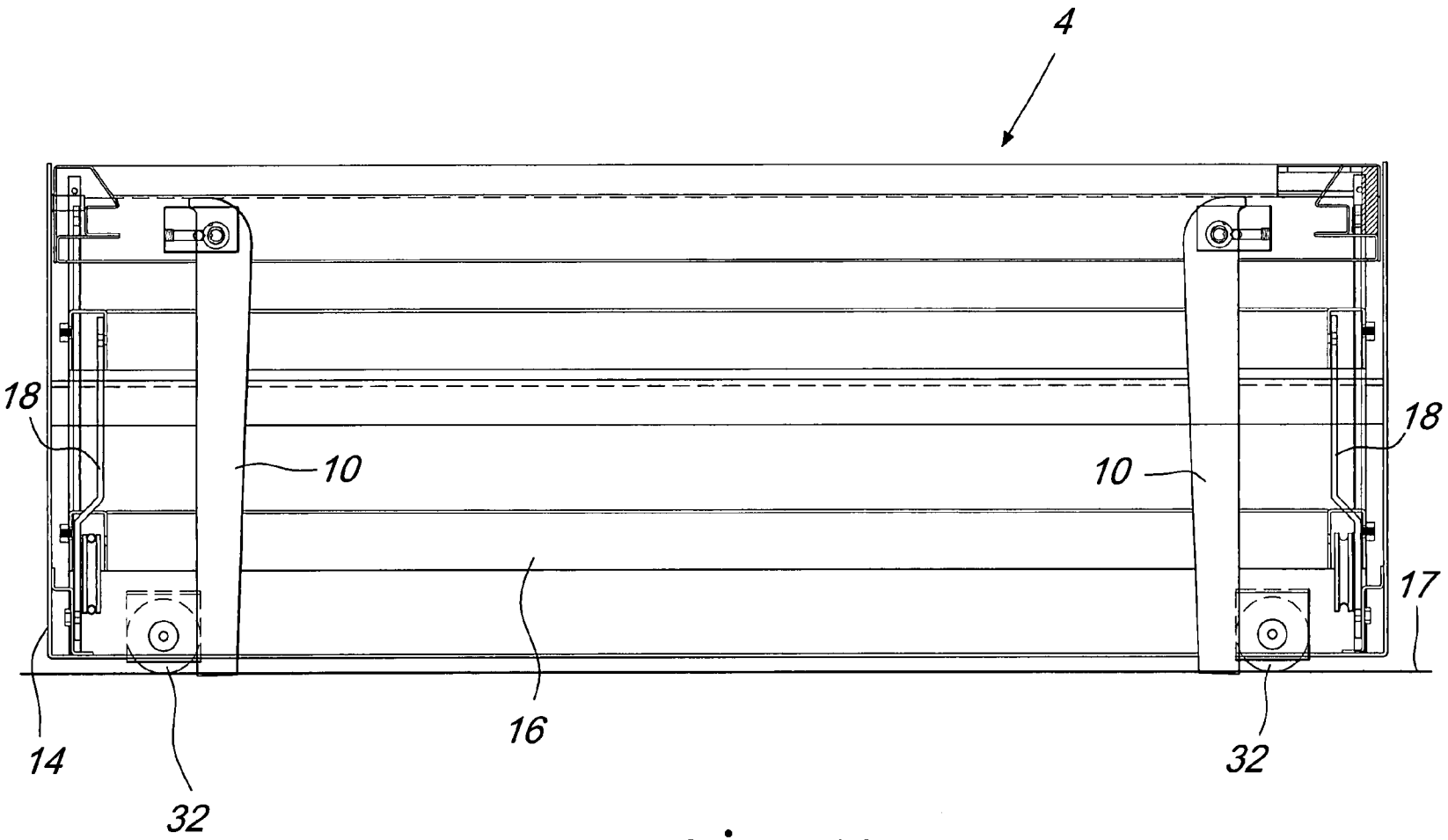
FIG. 10 is a front view of the chassis in the night position.
Figure 11:
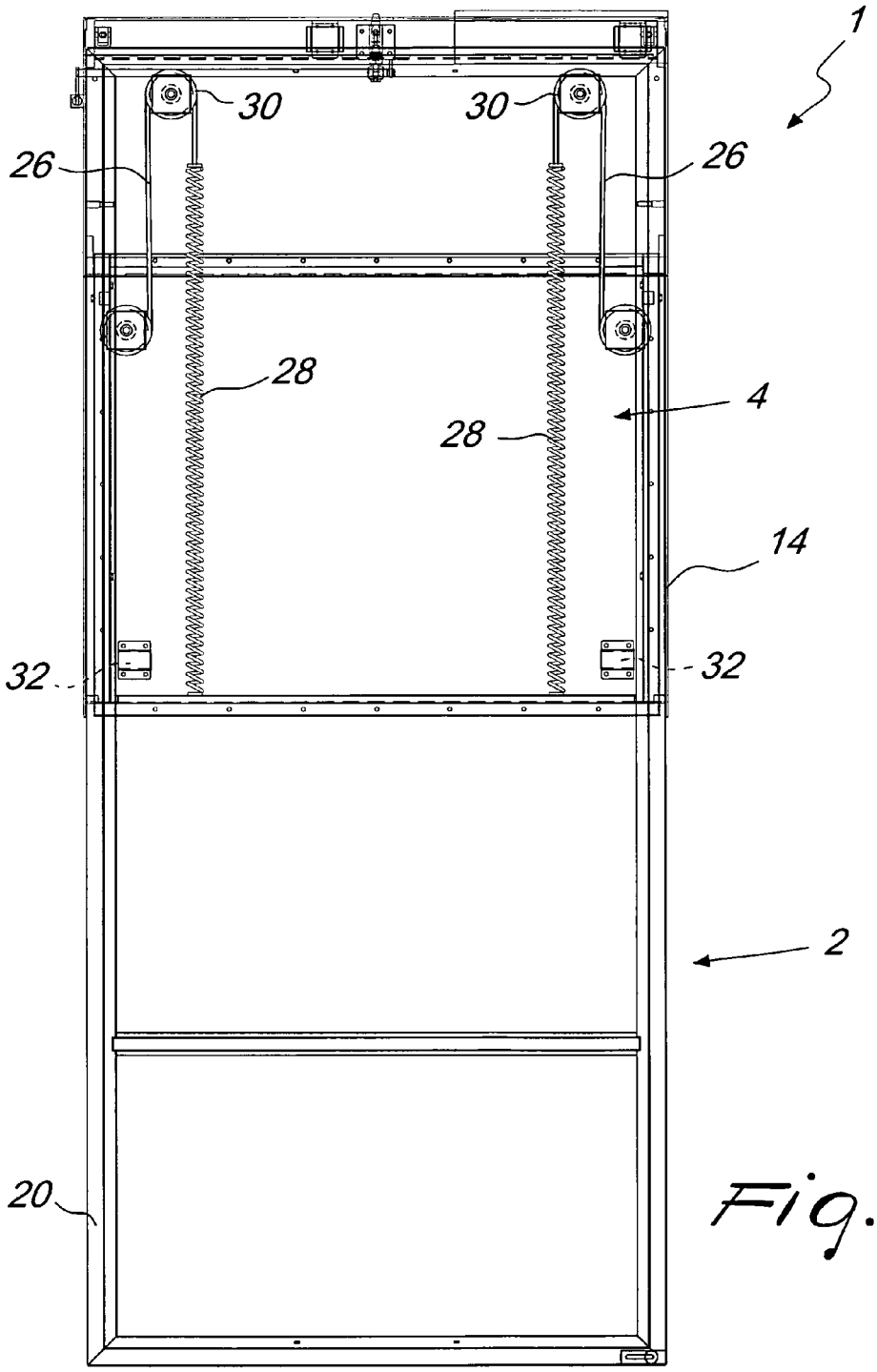
FIG. 11 is a plan view of the chassis in the night position.

In the joined or separated position, the two wall portions 2 and 3 can be tilted down, as shown schematically in FIGS. 5 and 6, to convert the unit from a sofa to a bed.

If the portions are joined, the unit constitutes a double bed; if the portions are separated, the unit constitutes two separate single beds, as shown in FIG. 6.

Each wall portion 2 and 3 has a shoulder, respectively 8 and 9.

The shoulders 8 and 9 are hinged to the chassis of the respective portion so as to constitute the sides of the piece of furniture against the wall, when the furniture unit is in the day version, visible in FIGS. 1 and 3, and the side boards of the beds when the unit is in the night version, visible in FIG. 6.

The wall portions 2 and 3 also comprises folding feet, respectively 10 and 11, which are actuated automatically when the wall portions are lowered to constitute a bed, as shown schematically in FIG. 5.

During the descent of the wall portions 2 and 3, an adapted mechanism also lowers the sitting portions 12 and 13 of the seat parts.

The seat parts constitute a base chassis on which the respective wall portion is hinged.

The seat part 4 comprises a metallic chassis 14, which is provided with wheels 32 in order to allow its transverse gliding on the floor 17.

A frame 16 is associated with the chassis 14 and supports the sitting portion 12. The frame 16 is associated with the base chassis 14 by means of an articulated parallelogram system, which includes a lever 18 that is articulated to a framework 20 that constitutes the sprung base of the bed.

The framework 20 is substantially a quadrangular structure to which it is possible to apply slats that constitute the sprung base of the bed.

The framework 20 is hinged to the chassis 14 in the fulcrum 22 and has two ends 24 that are associated with respective cable 26, whose opposite ends a associated with a respective spring 28 to constitute a system for balancing the framework or the wall portion.

The cables 26 are guided by means of guiding pulleys 30 associated with the base of the chassis 14.

The entire mechanism for the movement of the unit is therefore contained in the base chassis 14.

A locking means is also provided for locking the two seat parts and the corresponding beds in the two separated or joined positions.

The locking means comprises, in each assembly, a button 34, in the shoulders of the chassis, which actuates a shaft that is arranged on the base and is parallel to the floor and locks the assembly by means of a pin 36.

In practice it has been found that the invention achieves the intended aim and objects, providing a convertible furniture unit that constitutes an integrated sofa having an exposed wall and that can be converted into a collapsible double bed or into two mutually separate single beds.

Conversion from a double bed to single beds is performed with the unit in the day version, i.e., with the beds in the vertical position, by virtue of the sliding motion on the rail of the two units.

The spring-based balancing system and all the components of the mechanism such as levers, fulcrums, et cetera, are inside the supporting structure.

An advantage of the present invention is constituted by the fact that in the night version the unit does not have the traditional appearance of a piece of furniture exposed against a wall, because the shoulders of the piece of furniture are fixed to the sprung base of the bed and by turning become, in the night version, the side boards of the bed.

Another important advantage is constituted by the fact that the structure is self-supporting, i.e., it does not require fixing to the wall.

The materials, as well as the dimensions, may of course be any according to the requirements and the state of the art.

This application claims the priority of Italian Patent Application No. MI2008A000679 filed on Apr. 15, 2008, the subject matter of which is incorporated herein by reference.

The invention claimed is:

1. A convertible furniture unit comprising a first portion and a second portion, each portion being respectively associated with a first seat part and with a second seat part, each of said portions constituting a single bed that can be tilted down onto the respective seat part; said first portion, with said seat part, being associated with said second portion, with said seat part, by means of a rail member, which allows mutual transverse sliding of said two portions, forming a joined position and a separated position, in said joined or separated positions said two wall portions being able to tilt down in order to convert said unit from a sofa into a double bed, if said portions are joined, into two separate single beds, if said portions are separated;

wherein each of said seat parts comprises a chassis provided with means to allow transverse gliding of the furniture unit on a floor.

2. The furniture unit according to claim 1, wherein each of said portions comprises a shoulder that is hinged to the respective portion so as to constitute a side of the unit when said unit is in a day or sofa position, and a lateral band of the bed configuration when said unit is in a night or bed position.

3. The furniture unit according to claim 1, wherein said portions comprise folding feet, which are actuated automatically when said portions are lowered to constitute a bed.

4. The furniture unit according to claim 1, further comprising a mechanism which, during the descent of said portions, from a day or sofa position to said a night or bed position, also lowers a sitting portion of said seat parts.

5. The furniture unit according to claim 1, wherein said unit is self-supporting, and does not have to be fastened to a wall.

6. The furniture unit according to claim 1, wherein said means to allow transverse gliding of the furniture unit on a floor includes wheels.

7. The furniture unit according to claim 6, wherein a frame that supports a sitting portion of at least a respective one of said seat parts is associated with said chassis; said frame is associated with said chassis by an articulated parallelogram system which comprises a lever that is articulated to a framework that constitutes a sprung base of the respective single bed.

8. The furniture unit according to claim 7, wherein said framework is substantially a quadrangular structure to which it is possible to apply slats to constitute the sprung base of the bed.

9. The furniture unit according to claim 7, wherein said framework is hinged to said chassis and has two ends that are associated with respective cables whose opposite ends are associated with a respective spring to constitute a system for balancing the framework or said portion.

10. The furniture unit according to claim 9, wherein said cables are guided by pulleys associated with the base of said chassis.

11. The furniture unit according to claim 1, wherein said seat parts constitute a base chassis on which the respective portion is hinged.

12. The furniture unit according to claim 11, wherein the entire mechanism for moving the unit is contained in said base chassis.

13. The furniture unit according to claim 1, further comprising a means for locking said seat parts and the corresponding portions in said separated positions or said joined position.

14. The furniture unit according to claim 13, wherein said locking means comprises, in each of said first portion and second portion; a button, in a shoulder of the respective portions, which actuates a shaft, which is arranged on a base and is parallel to the ground and locks the respective portions by means of a pin.

15. A convertible furniture unit comprising a first portion and a second portion, each portion being respectively associated with a first seat part and with a second seat part, each of said portions constituting a single bed that can be tilted down onto the respective seat part; said first portion, with said seat part, being associated with said second portion, with said seat part, by means of a rail member, which allows mutual transverse sliding of said two portions, forming a joined position and a separated position, in said joined or separated positions said two wall portions being able to tilt down in order to convert said unit from a sofa into a double bed, if said portions are joined, into two separate single beds, if said portions are separated, further comprising means for locking said seat parts and the corresponding portions in said separated positions or said joined position, wherein said locking means comprises, in each of said first portion and second portion, a button, in a shoulder of the respective portions, which actuates a shaft, which is arranged on a base and is parallel to the ground and locks the respective portions by means of a pin.

16. A convertible furniture unit comprising a first portion and a second portion, each portion being respectively associated with a first seat part and with a second seat part, each of said portions constituting a single bed that can be tilted down onto the respective seat part; said first portion, with said seat part, being associated with said second portion, with said seat part, by means of a rail member, which allows mutual transverse sliding of said two portions, forming a joined position and a separated position, in said joined or separated positions said two wall portions being able to tilt down in order to convert said unit from a sofa into a double bed, if said portions are joined, into two separate single beds, if said portions are separated; wherein a frame that supports a sitting portion of at least a respective one of said seat parts is associated with a chassis; and wherein said frame is associated with said chassis by an articulated parallelogram system which comprises a lever that is articulated to a framework that constitutes a sprung base of the respective single bed.

17. The furniture unit according to claim 16, wherein said framework is substantially a quadrangular structure to which it is possible to apply slats to constitute the sprung base of the bed.

18. The furniture unit according to claim 16, wherein said framework is hinged to said chassis and has two ends that are associated with respective cables whose opposite ends are associated with a respective spring to constitute a system for balancing the framework or said portion.

19. The furniture unit according to claim 18, wherein said cables are guided by pulleys associated with the base of said chassis.

* * * * *